US005431132A

United States Patent [19]

Kreuter et al.

[11] Patent Number: 5,431,132

[45] Date of Patent: Jul. 11, 1995

[54] VARIABLE VALVE GEAR OF INTERNAL COMBUSTION ENGINES

[75] Inventors: Peter Kreuter; Joachim Reinicke-Murmann, both of Aachen, Germany

[73] Assignee: Meta Motoren-und Energie-Technik GmbH, Herzogenrath, Germany

[21] Appl. No.: 185,633

[22] Filed: Jan. 21, 1994

[30] Foreign Application Priority Data

Jan. 20, 1993 [DE] Germany ..... 43 01 453.4

[51] Int. Cl.[6] ..... F01L 1/18; F01L 1/02

[52] U.S. Cl. ..... 123/90.16; 123/90.17

[58] Field of Search ..... 123/90.15, 90.16, 90.17, 123/90.39, 90.41, 90.44

[56] References Cited

U.S. PATENT DOCUMENTS

| | | | |
|---|---|---|---|
| 4,714,057 | 12/1987 | Wichart | 123/90.15 |
| 4,724,822 | 2/1988 | Bonvallet | 123/90.16 |
| 5,052,350 | 10/1991 | King | 123/90.16 |
| 5,189,998 | 3/1993 | Hara | 123/90.16 |

FOREIGN PATENT DOCUMENTS

| | | | |
|---|---|---|---|
| 2484016 | 12/1981 | France | 123/90.16 |
| 2456752 | 8/1976 | Germany | 123/90.16 |
| 3531000 | 8/1986 | Germany . | |
| 3725448 | 2/1989 | Germany . | |
| 35115 | 3/1980 | Japan | 123/90.16 |
| 93/01223 | 12/1993 | WIPO . | |

*Primary Examiner*—Henry C. Yuen
*Assistant Examiner*—Weilun Lo
*Attorney, Agent, or Firm*—Felfe & Lynch

[57] ABSTRACT

Two camshafts 1 and 2 have cams which act through levers 3 and 5 and followers 7 and 8 on one or more valves 4 spring-loaded in the closing direction. One of the two camshafts determines the opening function and the other camshaft the closing function of the valve, so that through a phase shift of the camshafts with respect to one another, the stroke and the timing of the valve or valves can be varied in a wide range. The first camshaft (1) acts upon a drag lever (5) and the second camshaft (2) acts on a rocker lever (3) whose fulcrum is fixed to the drag lever. The axis of rotation of one of the camshafts is at least approximately in the extension of the longitudinal axis of the valve, and the frame-fixed fulcrum (P1) of the drag lever 5 and the fulcrum (P2) for the rocker lever (3) are disposed on opposite sides of the longitudinal axis of the valve. This makes it possible to create an especially compact, light and rigid construction of the valve gear.

20 Claims, 2 Drawing Sheets

VARIABLE VALVE GEAR OF INTERNAL COMBUSTION ENGINES

BACKGROUND OF THE INVENTION

This application is a continuation-in-part of the international application PCT/DE93/01223 designating the United States, filed Dec. 16, 1993.

The invention relates to valve gear for one or more overhead valves in an internal combustion engine, especially for the throttle-free load control of Otto-cycle engines, wherein the feeding of the mixture is performed by controlling the lift height and open time of the intake valves.

The invention represents an improvement over the apparatus described in the international application PCT/DE93/01223, the disclosure of which is incorporated herein by reference. This application discloses two camshafts acting on followers on respective connecting levers to control the opening and closing of one or more overhead valves which are spring biased in the closing direction, one of the camshafts controlling the opening and the other controlling the closing. By changing the relative timing of the camshafts, the lift and dwell of the valves can be varied widely.

In the apparatus disclosed in PCT/DE93/01223, one of the levers controlling each valve is a drag lever pivoted about a fixed fulcrum and carrying a follower acted on by one of the camshafts. The other lever controlling each valve is a rocker lever which is pivotably mounted on a fulcrum fixed to the drag lever, one end of the rocker carrying a follower acted on by the other of the camshafts, the other end acting on the valve stem. All of the valve operating components are situated on one side of the axis of the overhead valve as well as far away laterally from this axis, so that the valve train takes a lot of lateral space.

U.S. Pat. No. 4,714,057 discloses a system for the variable valve control for an internal combustion piston engine. In this case one of the shafts bears a conventional cam with opening and closing flanks, and the other shaft bears a cam for the advanced reduction of the closing movement of the valve. This patent discloses a phasing device for changing the relative timing of the two camshafts. Phasing devices are also disclosed in DE 29 09 803 and DE 35 31 000.

SUMMARY OF THE INVENTION

The present invention is directed to a valve train for the variable stroke and timing of valves, which valve train is narrow and compact in structure, but still has desired rigidity and kinematic properties. This is accomplished by situating the stationary first fulcrum for the drag lever (first rocker lever) on the opposite side of the valve stem from the movable second fulcrum for the second rocker lever, and by locating the axis of rotation of one of the camshafts above the valve stem. An especially close spacing of the camshafts can be achieved if the drag lever is a forked member having two arms, and the movable fulcrum for the rocker lever is situated between the arms. This permits offsetting the cams and spacing the camshafts at a distance which is less than the lift radii of the cams.

DETAILED DESCRIPTION OF THE PREFERRED EMBODIMENT

Figure 1:
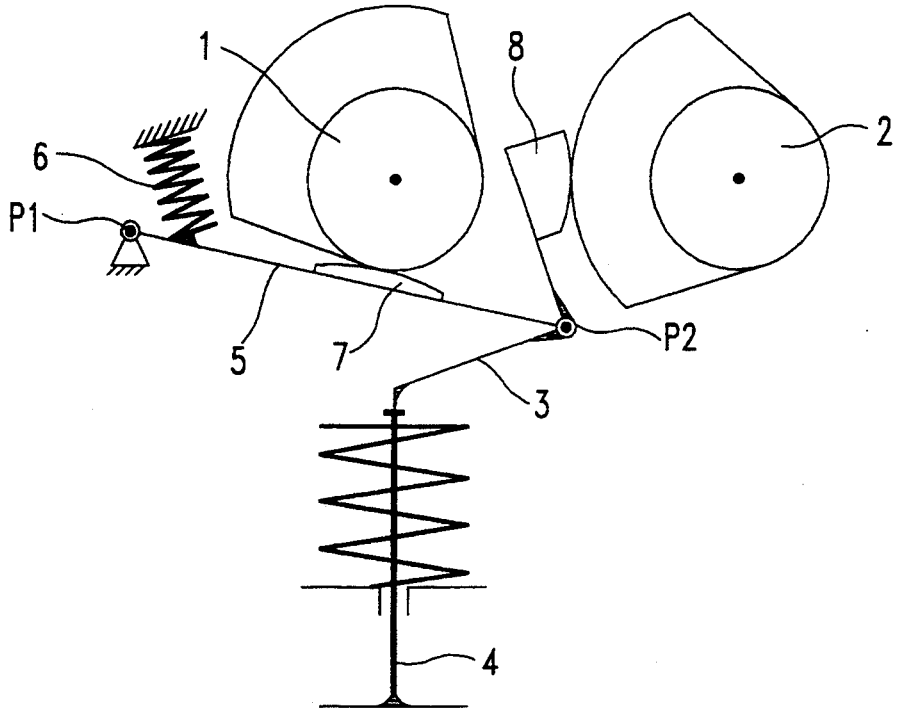
FIG. 1 is a diagrammatic view of the system according to the invention.

The basic configuration of the system will be seen in FIG. 1. The system consists of a first camshaft 1 rotating counterclockwise and a second camshaft 2 rotating clockwise at the same speed and having cams which act on appropriately shaped cam followers 7, 8, the first camshaft 1 determining the opening function and the second camshaft the closing function. The rocker 3 is connected to stationary pivot P1 by a movable pivot P2 and connecting lever 5, and transmits the lifting movements of the cam shafts to an overhead valve 4 of conventional construction which is spring-biased in the closing direction. By rotation of the camshafts in opposite directions and relative to each other, the resultant movement of the valve 4 can be varied widely during operation both as regards the open time and as regards the lifting height.

The first camshaft 1 acts through the first cam follower 7 on the first rocker lever 5 configured with a fixed fulcrum P1, and the second camshaft 2 acts through the second cam follower 8 on the second rocker 3 configured with a moving fulcrum P2. This construction has the advantage that the structural shape and the action of the moving components of the valve gear can be configured substantially like the corresponding conventional valve gear components, and also do not require any greater amount of space. The cam followers (7, 8) can be configured as sliding or rolling cam followers.

The valve gear operates like an AND-circuit; the valve 4 is opened only when the cams on both camshafts are engaged. Prior to opening, the ascending flank of the cam on camshaft 2 pivots rocker 3 anticlockwise about P2 until the lift circle slides against follower 8 to the position shown in FIG. 1. After this the ascending flank of the cam on camshaft 1 pivots the first lever 5 clockwise about P1 to open the valve. Closing is then accomplished by the descending flank of the cam on camshaft 2. Minimum valve lifts at very brief open periods can be achieved by rotating the camshaft 2 clockwise relative to the position of camshaft 1 as seen in FIG. 1. Maximum valve lifts at longer open periods can be achieved by rotating camshaft 2 counterclockwise relative to the position of camshaft 1 as seen in FIG. 1. A suitable camshaft phasing device is disclosed in DE-OS 29 09 803. Here a driven gear is positively joined through a sleeve provided with a helical groove to a camshaft such that by axial displacement of the sleeve a relative rotation of the driving gear with respect to the camshaft is achieved.

In an advantageous embodiment of the invention, the axis of rotation of one of the two camshafts (here camshaft 1) is located at least approximately in the projection of the longitudinal axis of the valve 4. This results in the desired narrow design of the system in the longitudinal direction of the valve. Furthermore, this corresponds to the camshaft position of extended, directly actuated valve gears of conventional design, so that a changeover of existing cylinder heads to the valve gear according to the invention is easy to accomplish.

An especially compact and thus desirable arrangement of the moving components can be had if the frame-fixed fulcrum P1 of the first lever 5 and the joint P2 between first lever 5 and second rocker lever 3 are disposed on different sides of the longitudinal axis of the valve.

In order to maintain a defined contact between the rocker 3 and the end of the stem of the valve 4 and the camshaft 2, a force is applied to the connecting lever 5, using a suitable spring 6. The spring 6 can advantageously be a compression spring and can be disposed in the position shown. It can also be a tension spring or a rotary spring. In this manner undefined movements of the rocker 3 are prevented on the one hand, and on the other hand the number of phases of the movement of the rocker 3 is reduced to the necessary minimum.

Figure 2:
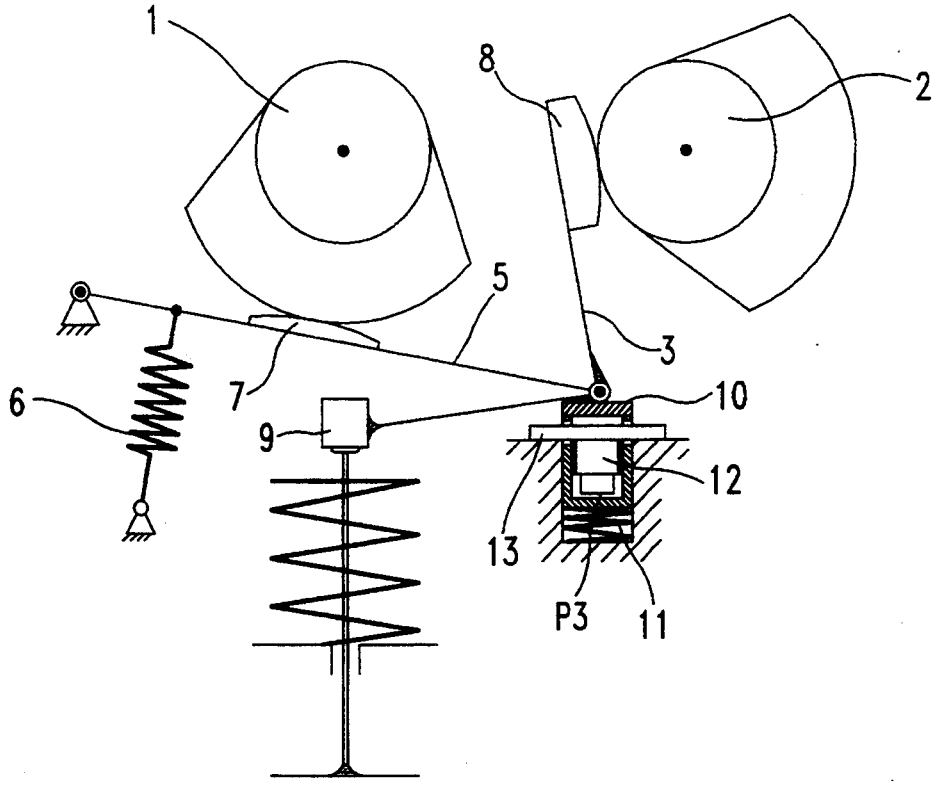
FIG. 2 is a diagrammatic view of an embodiment with a hydraulic clearance compensating means, FIG. 3 a diagrammatic perspective view of the drag lever in the form of a fork.

The valve gear according to the invention also permits the use of hydraulic valve lifters 9 as shown in FIG. 2, such as those used in valve gear of conventional construction. See, e.g., U.S. Pat. No. 2,804,060 to Bergmann. It is then necessary, however, to limit the movement of the drag lever 5 by means of an automatic adjusting system, which will be further explained with the aid of the embodiment represented.

When the camshaft 1 is in a position corresponding to the maximum lift, as shown in FIG. 2, the thruster 10 is urged by the spring 11 against an appropriate surface which can be on the rocker 3 or on the pull lever 5 so that the cam follower 7 comes in contact with the lift surface of the camshaft 1 without any free play. By the appropriate selection of the springs 11 and 6 it can be assured that the force of the spring 11 on the thruster 10 is greater than the force exerted by spring 6 on the thruster 10, which is here configured as a shell guided in a bore.

If the first camshaft 1 now turns further, after passing through the stroke circle a chatter will occur between the cam follower 7 and the camshaft 1 and between rocker 3 and the thruster 10. The spring 11 can thus force the thruster 10 further out of the bore. This movement works against the hydraulic clearance equalizer 12 of conventional construction, which in turn is supported on the one hand on the thruster 10 and on the other hand on the bridge 13 on the frame. In this manner the movement of the thruster 10 out of the bore can take place but very slowly in accordance with the sinking rate of the clearance equalizer 12. The sinking rate of the clearance equalizer 12 is advantageously selected so as to allow for the force of the spring such that the adjustment movement of the thruster 10 during the adjustment is very small. As the camshaft 1 rotation continues, the rocker 3 is moved by the camshaft 1 back toward the thruster 10 until the cam follower 7 again contacts the camshaft 1 in the area of the lift circle. In this manner the cam follower 10 is pushed back into the bore and a clearance is formed between the thruster and the clearance equalizer 12 at point P3, which corresponds to the sinking range. This clearance, however, is immediately equalized by the clearance equalizer 12, so that no clearance remains. The clearance equalizing means can be supplied with hydraulic fluid conventionally, e.g., through appropriate oil bores in the valve cover and circulation grooves in the clearance equalizing means 10.

Figure 3:
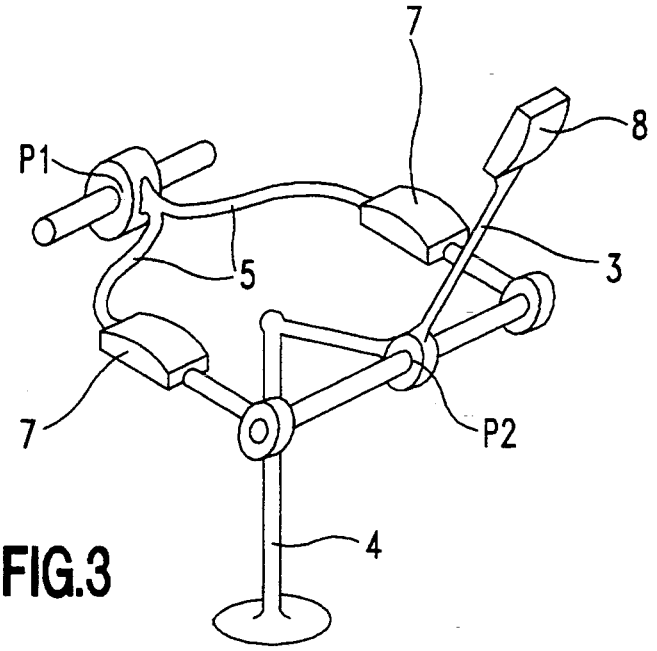

FIG. 3 shows a configuration of the connecting lever 5 in the form of a forked lever, which offers an appreciable additional reduction of the necessary space. The articulation of the connecting lever 5 on the frame at point P1 can be made by means of a shaft, as shown, or also by means of a ball joint. The rotating joint between the connecting lever 5 and rocker 3 at point P2 is also provided by means of a shaft or ball joints.

Figure 4:
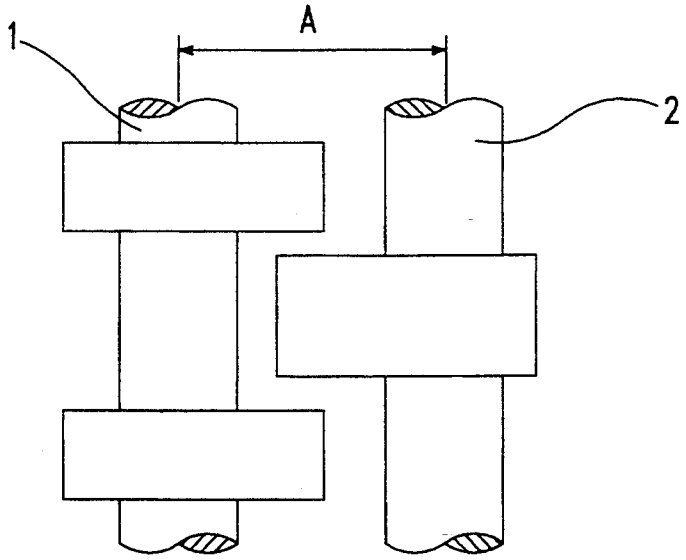
FIG. 4 is a partial plan view of the camshafts arranged close to one another.
Figure 5:
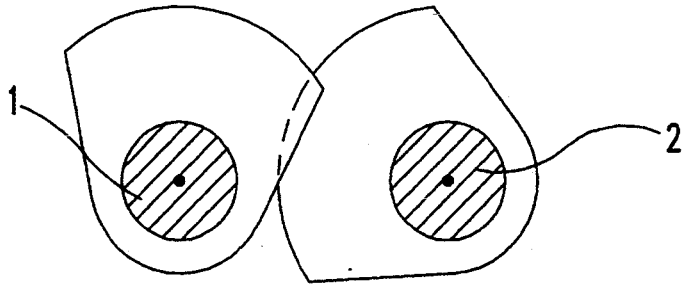
FIG. 5 is an end section of the camshafts arranged close to one another.

The space requirement of a valve gear of this kind also depends substantially on the distance A between the two camshafts. An especially short distance A is possible if the cams on the camshafts 1 and 2 are disposed axially offset from one another, for example as represented in FIG. 4. By this arrangement of the cams it is possible for the distance A to be less than the lift circle radii of the camshafts, as also illustrated in FIG. 5. Further, the sensitivity of the valve gear is reduced as regards torque. This again results in greater freedom in the configuration of the cam flanks with regard to the kinematic and dynamic limiting conditions and the pressures produced on the surface of the cam.

In the case of internal combustion engines with two or more induction or exhaust valves per cylinder unit, the system can be configured so that the valves are actuated singly or in groups. In this manner various stroke functions of the valves of a cylinder can be achieved, which is advantageous, for example, during induction in the partial-load range or for the sake of better utilization of gas fluctuations in the connected ducting.

We claim:

1. Apparatus for controlling the lift and timing of valves in an internal combustion engine, comprising first and second camshafts arranged to rotate about respective first and second axes of rotation in opposite angular directions, a first rocker lever pivotable about a stationary first fulcrum and carrying a first follower acted upon by said first camshaft, and a second rocker lever pivotable about a movable second fulcrum fixed to said first rocker lever and carrying a second follower acted on by said second camshaft, said second rocker lever acting on a spring biased valve having a stem defining a longitudinal axis, said first and second camshafts being profiled and arranged so that only one of said camshafts effects opening movements of said valve and only the other of said camshafts effects closing movements of said valve.

2. Apparatus as in claim 1 wherein one of said axes of rotation intersects an extension of said longitudinal axis.

3. Apparatus as in claim 1 wherein said first and second fulcrums are located on opposite sides of said longitudinal axis.

4. Apparatus as in claim 1 wherein said second rocker lever is always in contact with said stem and said second camshaft.

5. Apparatus as in claim 1 further comprising spring loaded thrust means and hydraulic clearance equalizing means acting on said first rocker remotely from said first fulcrum.

6. Apparatus as in claim 1 wherein said first rocker lever is configured as a forked member having two arms carrying said second fulcrum therebetween.

7. Apparatus as in claim 1 wherein said first and second camshafts carry respective cams which are axially offset from one another.

8. Apparatus as in claim 7 wherein said respective cams have lift circle radii, said first and second axes of rotation being spaced apart by a distance which is less than the sum of the respective lift circle radii.

9. Apparatus as in claim 1 wherein said first camshaft rotates counter-clockwise.

10. Apparatus as in claim 1 wherein only said first camshaft effects opening movements of said valve.

11. Apparatus as in claim 1 wherein said second rocker lever contacts said valve stem.

12. Apparatus as in claim 1 wherein said first follower lies between said stationary first fulcrum and said movable second fulcrum.

13. Apparatus as in claim 1 wherein said movable second fulcrum lies between said second follower and said valve stem.

14. Apparatus as in claim 1 wherein said camshafts are profiled and arranged so that, through a phase shift of the camshafts with respect to one another, either camshaft may be used to effect opening movements of said valve.

15. Apparatus for controlling the lift and timing of valves, said apparatus comprising first and second camshafts arranged to rotate about respective first and second axes of rotation in opposite angular directions, each camshaft bearing at least one cam having an ascending flank, a descending flank, and a lift circle of constant radius extending from said ascending flank to said descending flank, a first rocker lever pivotable about a stationary first fulcrum and carrying a first follower acted on by said cam on said first camshaft, a second rocker pivotable about a movable second fulcrum fixed to said first rocker lever and carrying a second follower acted on by said cam on said second camshaft, said second rocker contacting a spring biased valve having a stem defining a longitudinal axis, said cams on said first and second camshafts being profiled and arranged so that the ascending flank of said cam of one of said camshafts contacts one of said followers to open said valve while said lift circle of said cam of the other of said camshafts contacts the other of said followers, and so that the descending flank of said cam of the other of said camshafts contacts the other of said followers to close said valve while said lift circle of said cam of said one of said camshafts contacts said one of said followers.

16. Apparatus as in claim 15 wherein said first and second fulcrums are on opposite sides of said longitudinal axis.

17. Apparatus as in claim 15 wherein said first follower lies between said stationary first fulcrum and said movable second fulcrum.

18. Apparatus as in claim 15 wherein said cams on respective first and second camshafts are axially offset from one another, said first and second axes of rotation being spaced apart by a distance which is less than the sum of the respective lift circle radii.

19. Apparatus as in claim 15 wherein said first rocker is configured as a forked member having two arms carrying said second fulcrum therebetween.

20. Apparatus as in claim 15 further comprising spring loaded thrust means and hydraulic clearance equalizing means acting on said first rocker lever remotely from said first fulcrum.

* * * * *